US006425647B1

(12) United States Patent
Pothin

(10) Patent No.: US 6,425,647 B1
(45) Date of Patent: Jul. 30, 2002

(54) ROTATABLE JEWELRY CABINET

(76) Inventor: Florence Pothin, 949 E. 84th St., Chicago, IL (US) 60619

( * ) Notice: Subject to any disclaimer, the term of this patent is extended or adjusted under 35 U.S.C. 154(b) by 0 days.

(21) Appl. No.: 09/431,234

(22) Filed: Nov. 1, 1999

Related U.S. Application Data

(63) Continuation-in-part of application No. 08/536,101, filed on Sep. 29, 1995, now abandoned.

(51) Int. Cl.[7] ..... A47B 49/00
(52) U.S. Cl. ..... 312/249.2; 312/135; 312/249.4
(58) Field of Search ..... 312/249.1, 249.2, 312/249.3, 249.4, 125, 126, 128, 135, 138.1, 114, 139.1, 285, 136

(56) References Cited

U.S. PATENT DOCUMENTS 617,252 A * 1/1899 Levitt et al. ..... 312/249.2 X
791,101 A * 5/1905 Klein ..... 312/135
1,029,709 A * 6/1912 Norrlander ..... 312/249.4
1,393,050 A * 10/1921 Talley et al. ..... 312/135
4,300,809 A * 11/1981 Brownle ..... 312/135 X
4,322,007 A * 3/1982 Feibelman ..... 211/163
4,850,658 A * 7/1989 Sandor ..... 312/225
5,549,373 A * 8/1996 Bustos ..... 312/135
5,678,908 A * 10/1997 Wang ..... 312/249.4 X

* cited by examiner

*Primary Examiner*—Peter M. Cuomo
*Assistant Examiner*—Stephen Vu
(74) *Attorney, Agent, or Firm*—JoAnne A. Denison; Denison & Assoc, PC

(57) ABSTRACT

A rotatable jewelry cabinet is provided with numerous mechanisms for holding and displaying large quantities of jewelry by providing a domed enclosed structure with four curved glass doors, an upper service tray and a lower service tray for receiving numerous bottles of creams, lotions, cosmetic and nail polish bottles and the like, a plurality of hooks depending from the top of the interior of the rotatable jewelry cabinet for hanging necklaces and bracelets therefrom, a plurality of circular curtain walls containing apertures adapted to receive pierced earrings within the apertures or clip earrings directly on the curtain walls, and finally, a plurality of wedge shaped drawers located in the base of the cabinet for receiving other miscellaneous items which cannot be otherwise secured.

10 Claims, 4 Drawing Sheets

ROTATABLE JEWELRY CABINET

This application is a continuation-in-part of U.S. patent application No. 08/536,101, filed on Sep. 29, 1995, now abandoned.

FIELD OF THE INVENTION

The present invention relates to the area of jewelry cabinets in which jewelry can be readily displayed and stored, and more particularly, those which are easily rotated by the user for both viewing and selecting the jewelry contained therein and which contain a variety of securement devices including hooks, apertures and drawers for holding large, varied quantities of jewelry and cosmetics.

DESCRIPTION OF THE PRIOR ART

There are numerous devices seen in the prior art which allow the user to store and select jewelry or other similar items. For instance, Abraham, U.S. Pat. No. 4,697,856, discloses a medicine cabinet with interior rotatable pie shaped cabinets which can rotate independent of one another in order to conveniently dispense medicine. Feibelman, U.S. Pat. No. 4,322,007 discloses a rotatable jewelry stand which has exterior hooks for hanging necklaces or bracelets, and lateral bars for hanging earrings on cards. However, neither of these devices discloses a singular rotatable jewelry case with hooks for hanging necklaces and bracelets, apertures for hanging pierced earrings, and drawers for storing other miscellaneous items.

Likewise, Camp, U.S. Pat. No. 5,054,624, discloses a rotatable jewelry caddy having apertures for displaying pierced earrings and exterior hooks for hanging necklaces and bracelets, but it does not provide any means for storing the items to be displayed in an dust free environment. Nor does it have any additional means for storing items which can not be hung on hooks or held within the apertures.

In another patent issued to Patterson, U.S. Pat. No. 3,997,050, there is disclosed a jewelry caddy which is rotatable, has exterior hooks for earrings and necklaces and provisions for storing pierced earrings. However, the Patterson device does not disclose any means for storing jewelry or other items which cannot be hung by a hook or pierced through a piece of material.

The Handler, et al. patent, U.S. Pat. No. 4,126,366, discloses a rotatable, multiple storage bin assembly which could be convenient for storing certain items of jewelry, but because jewelry is stored within a plurality of bins, it is not as readily viewable by the user, and moreover, may not be suitable for all types of jewelry, such as small diamond pierced earrings which could be difficult to see in such an arrangement.

Nowhere in the prior art is seen a rotatable jewelry cabinet having interior hooks for hanging necklaces and bracelets, a plurality of circular curtain walls for storing pierced, clip on or suspended attachments, and a service tray for similar miscellaneous items, including cosmetic bottles, all of which are conveniently stored in a dust proof domed structure.

SUMMARY OF THE INVENTION

The present invention comprises a rotatable, domed shaped jewelry cabinet having circular curtain walls containing a plurality of apertures for securing and displaying pierced or clip on earrings; upper and lower service trays with a plurality of recesses for containing and displaying miscellaneous items such as articles of jewelry which cannot be hung on hooks or through apertures, or cosmetic bottles and containers; a plurality of wedge shaped drawers for holding miscellaneous items and a plurality of interior hooks for holding and displaying bracelets and necklaces, all of which are held within a closed domed shaped structure provided with four curved glass doors. Such a device provides a mechanism for easily storing and displaying large quantities of jewelry, especially earrings of a variety of shapes and sizes without interference from one another. The jewelry cabinet keeps all jewelry in clear view for easy access to a chosen selection or selection and free from dust, debris and oxygen which can tarnish jewelry made from precious metal.

The jewelry cabinet doors and domed top are preferably made from glass which provides for superior transparency and resistance from scratches. In the alternative, less expensive materials such as plastics, plexiglass and other rigid polymers may be used so that the interior contents of the structure may be easily viewed.

The glass doors and domed lid are preferably framed in an attractive hardwood such as oak or birch which adds to the aesthetic appeal of the device while providing a sturdy frame for the structure. However, a frame is not necessary to the structural integrity of the device and the invention may be made entirely from plastic, plexiglass or other similar rigid polymeric substance.

The upper and lower service trays are preferably made from plastic or painted wood for easy cleanup and resistance to staining from any cosmetic fluids such as nail polish or remover, perfumes which destroy wood finishes, foundations which contain a large amount of pigments that are difficult to wipe up and other greasy, powdery and messy liquids. Although one preferred embodiment utilizes both upper and lower service trays, such that no horizontal surface is left unused, it is contemplated that smaller and/or less expensive versions of the device might have one or both service trays eliminated and a simple flat surface may be provided in lieu thereof.

OBJECTS OF THE INVENTION

Thus, it is an object of the present invention to provide a jewelry cabinet which is rotatable in nature for easy selection of a wide variety of jewelry, cosmetics and other miscellany.

It is a further object of the present invention to provide a rotatable jewelry cabinet which is capable of holding a large quantity of jewelry by providing interior hooks for holding and displaying necklaces and bracelets together with means for holding and displaying both clip on and pierced earrings, service trays with shallow recesses for holding cosmetics, and wedge shaped drawers for holding other miscellany.

It is yet a further object of the present invention to provide a rotatable jewelry cabinet having four curved glass doors for easy access to the entire interior of the cabinet.

It is yet a further object of the present invention to provide for a plurality of hooks in the upper portion of the jewelry cabinet which allow necklaces and bracelets to be readily viewed and selected by the user thereof.

It is additionally a further object of the present invention to provide a rotatable jewelry cabinet having at least one service tray containing a plurality of wells for holding bracelets, cosmetics and other miscellany in place during rotation of the cabinet.

It is also a further object of the present invention to provide a rotatable jewelry cabinet with a plurality of substantially wedge shaped drawers to hold miscellaneous items, as well as hooks for necklaces and bracelets and curved curtain walls containing a plurality of apertures for pierced as well as clip on earrings.

These and other objects and advantages of the present invention can be readily derived from the following detailed description of the drawings taken in conjunction with the accompanying drawings present herein and should be considered as within the overall scope of the invention.

DETAILED DESCRIPTION OF THE DRAWINGS

Figure 1:
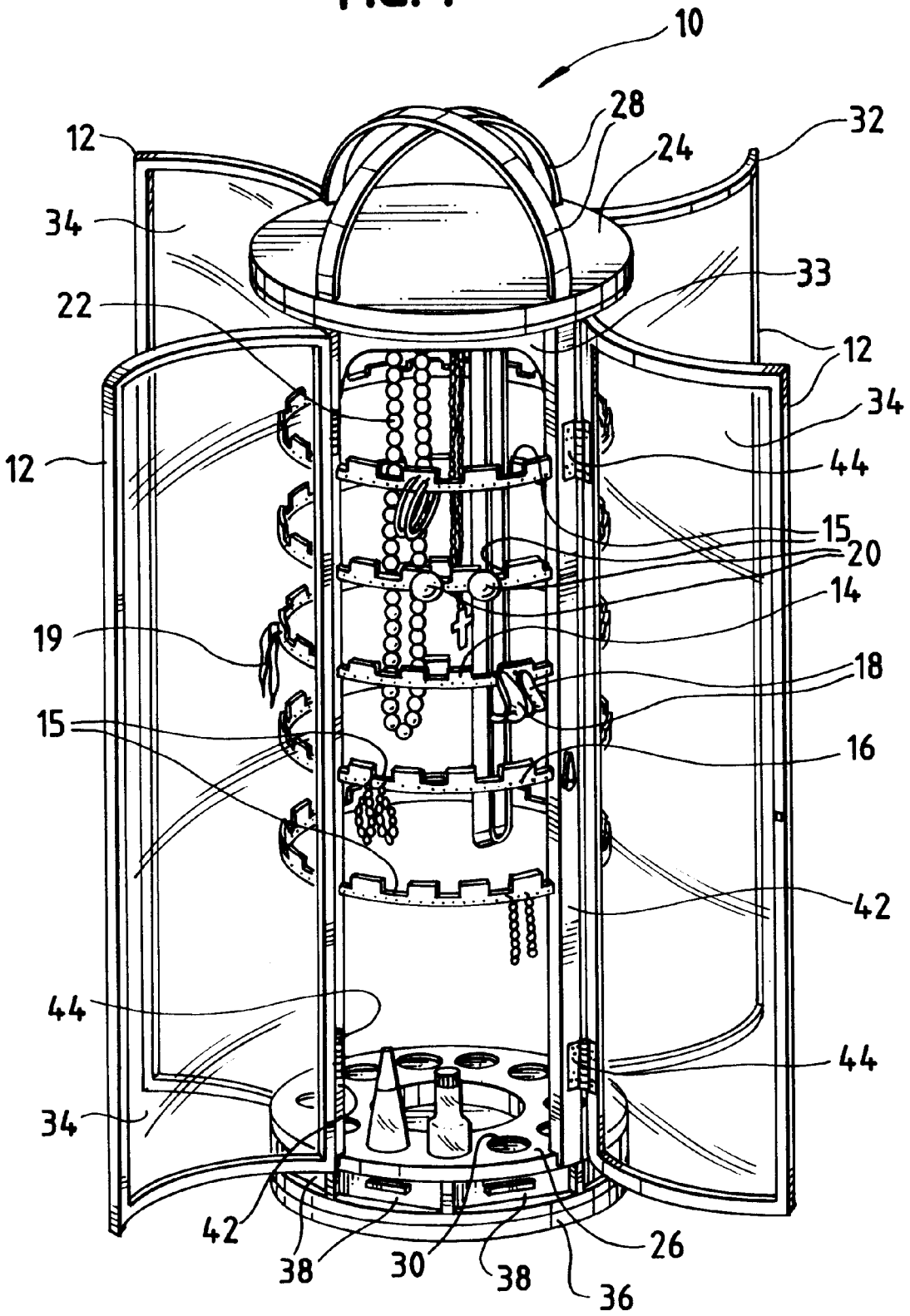
FIG. 1 shows a perspective view of the present invention showing the rotatable jewelery cabinet opened and filled with jewelry.

FIG. 1 shows a perspective view of the present invention, rotatable jewelry case 10 in which three of four curved glass doors 12 have been opened such that rotatable jewelry case 10 allows easy access to all the jewelry contained therein. In this particular instance, earrings 18 and 19 are pierced and curtain wall 14 has been provided with a plurality of apertures such that the posts of earrings 18 and the hooks of earring 19 may be easily slipped therethrough. The curtain wall 14 also contains depressions 15 which allow clip earrings 20 to be easily attached thereto. The back of clip earrings 20 are shown to illustrate the manner in which clip earrings may be readily accommodated upon the depression 15 of circular curtain walls 14. A variety of necklaces 19 are hung in the center of the circular curtain walls 14 in the interior cylindrical open space of rotatable jewelry case 10. The central open space of rotatable jewelry case 10 is sufficiently large to hold a large quantity of necklaces upon hooks which have been secured to the top of the interior of jewelry case 10.

All horizontal surfaces in rotatable jewelry case 10 are functional in nature. Both top service tray 24 and lower service tray 26 have been provided with a variety of recesses 30 which may be also varied in shape, as desired, so as to hold a wide variety of different bottles containing substances such as nail polish, cosmetics, perfumes, and the like. In this instances, circular recesses 1.5" to 2.0" in diameter are shown and are approximately 0.25" deep. Such a dimension has been chosen as preferable to retain miscellaneous items in place during rotation of rotatable jewelry cabinet 10. It is preferable, for this reason that both top service tray 24 and lower service tray 26 be made from painted wood or plastic or other polymers so that these trays are easy to clean and highly resistant to damage from chemical fluids.

Nonetheless, door frame 32, curtain walls 14, cabinet frame 33 and domed arches 28 may be made from a decorative hardwood such as oak, birch, cherry and the like to provide a pleasing aesthetic appearance to the device. However, where economy is important, these structural elements may be made from any rigid plastic or polymeric substance. Likewise, although this preferred embodiment shows the use of glass panes 34, any rigid plastic or polymeric substance which is transparent may be used.

Cabinet frame 33 consists of four vertical uprights 42 which have been attached to circular curtain wails 14 which have a plurality of apertures 16, and curved glass doors 12 via standard hinges 44. This provides for a sturdy cabinet which may easily be rotated by the user.

In this particular embodiment, rotatable jewelry case is also outfitted with a plurality of wedge shaped drawers 38 located circumferentially around rotating base 36. These shallow drawers may be used to hold a variety of jewelry items which cannot be hung from hooks or clips or through small apertures, as in the case of pierced earrings, but must be stored flat, such as pins and brooches. Other uses for the plurality of wedge shaped drawers 38 might include hair pins, bobby pins, pony tail holders, combs and hair brushes, and the like. Two drawers are shown under each quarter section of the cabinet; however the number of wedge shaped drawers may be varied according to the suitability of the design desired.

The rotatable jewelry cabinet 10 further contains a rotating base 36 which allows the user to swivel the cabinet a full 360° with ease. The rotating base 36 contains a standard lazy susan design with a set of tracks and plurality of ball bearings.

Figure 2:
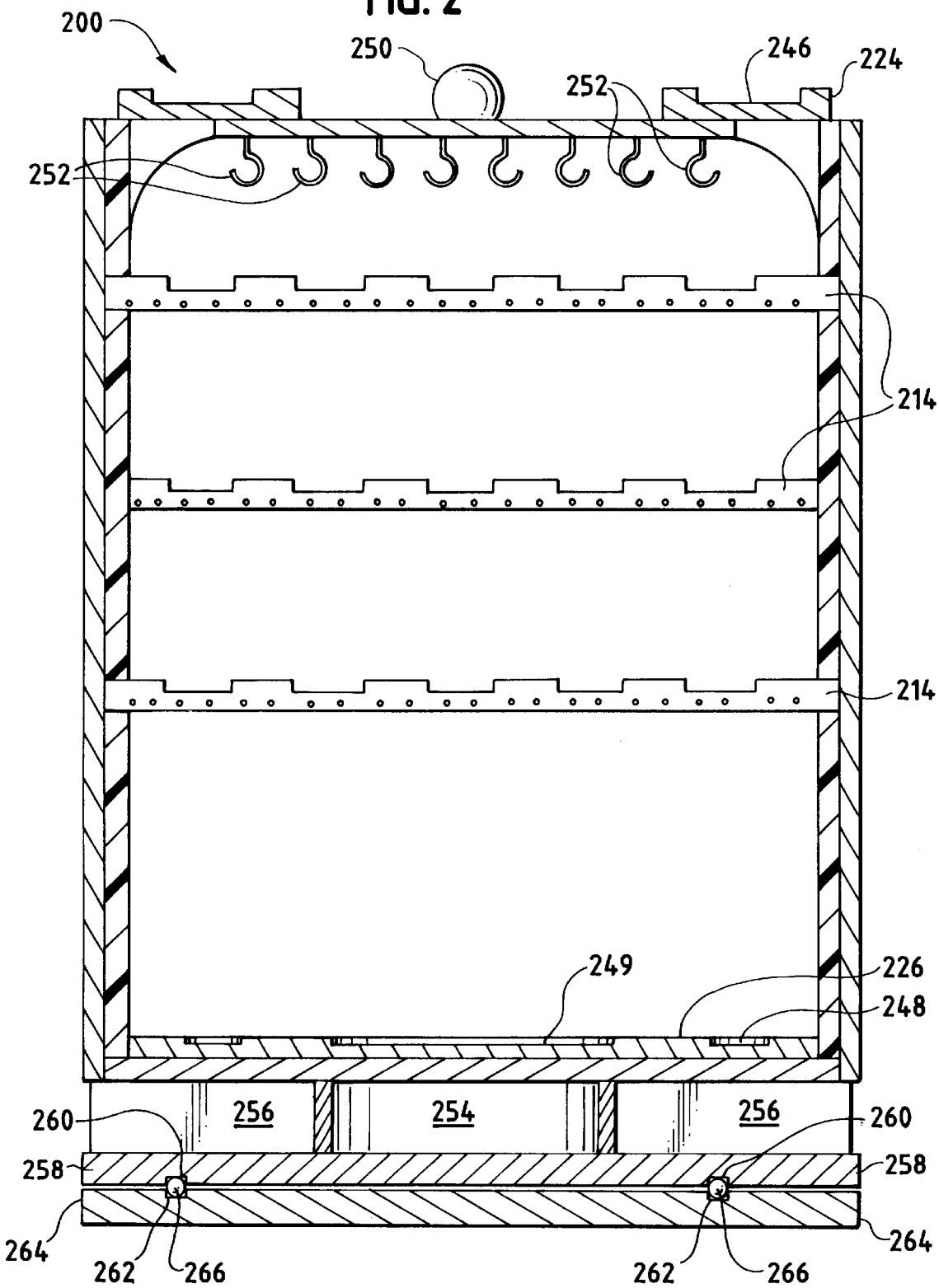
FIG. 2 shows an elevational cross section of a second embodiment of the present invention.

FIG. 2 shows in greater detail the interior construction of a second embodiment of the present invention showing top service tray 224 and lower service tray 226 with a variation of the size of shallow recesses 246, 248, and 249 present in top service tray 224 and lower service tray 226. Pivot point 250 is also shown as a convenient knob for the user to turn at will. Most importantly, FIG. 2 shows the detail of how a plurality of hooks 252 depend from the lower surface of the interior of rotatable jewelry case 200. Also shown in this detail is inner cylindrical surface 254 and drawer cavities 256 which are adapted to receive wedge shaped drawers in the base of rotatable cabinet 200.

The mechanism for rotating rotatable jewelry cabinet can also be seen in FIG. 2. Such a structure is commonly known to those skilled in the art, and such a mechanism typically consists of an upper disc 258 into which has been cut circular groove 260, and a corresponding lower disc 264 into which has been cut a second circular groove 262. Sandwiched in between the two circular grooves 260 and 262 are a plurality of ball bearings 266.

Figure 3:
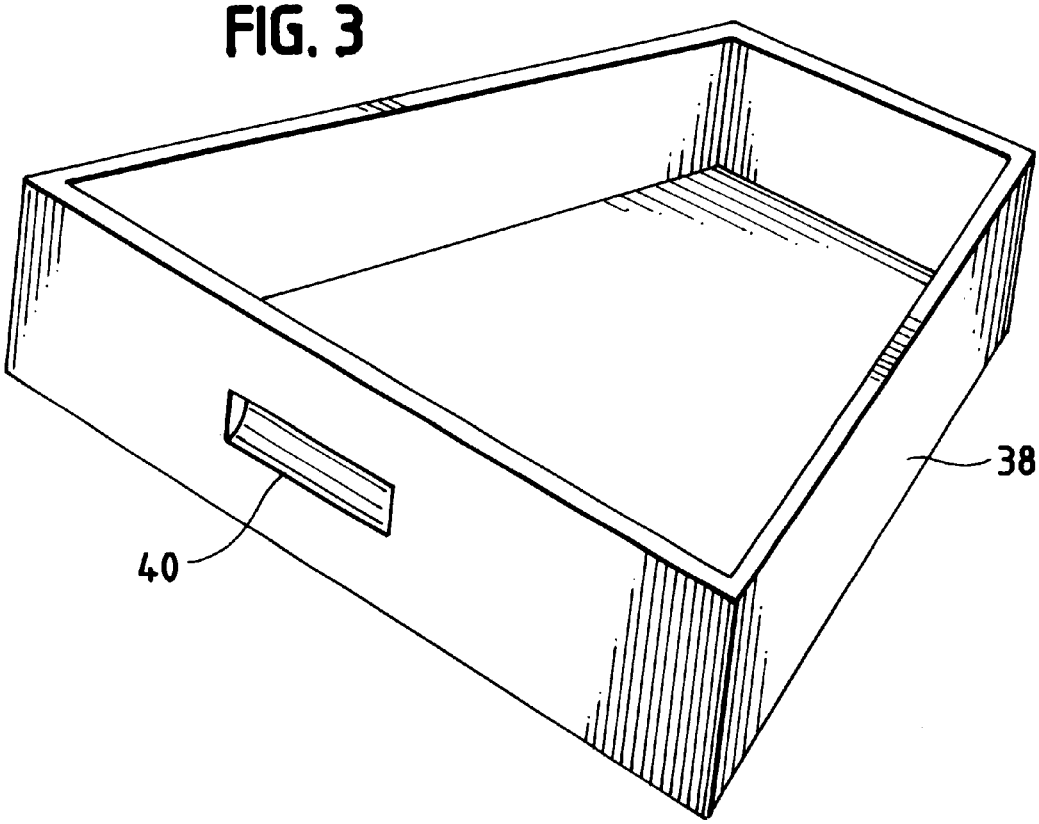
FIG. 3 shows a perspective view of one of the wedge shaped drawers.

FIG. 3 shows a perspective view of one of the wedge shaped drawers 38 with handle recess 40 of the present invention. Wedge shaped drawers are used inasmuch as they make efficient use of space when used in a cylindrical jewelry cabinet such as rotatable jewelry cabinets 10 and 200. However, it is certainly anticipated that the present invention may be made in a variety of overall shapes such as square, rectangular, oval, hexagonal, octagonal and the like, and the drawers in the base may be shaped accordingly. Certainly in a square or rectangular shaped cabinet the drawers may be square or rectangular instead of wedge shaped.

Figure 4:
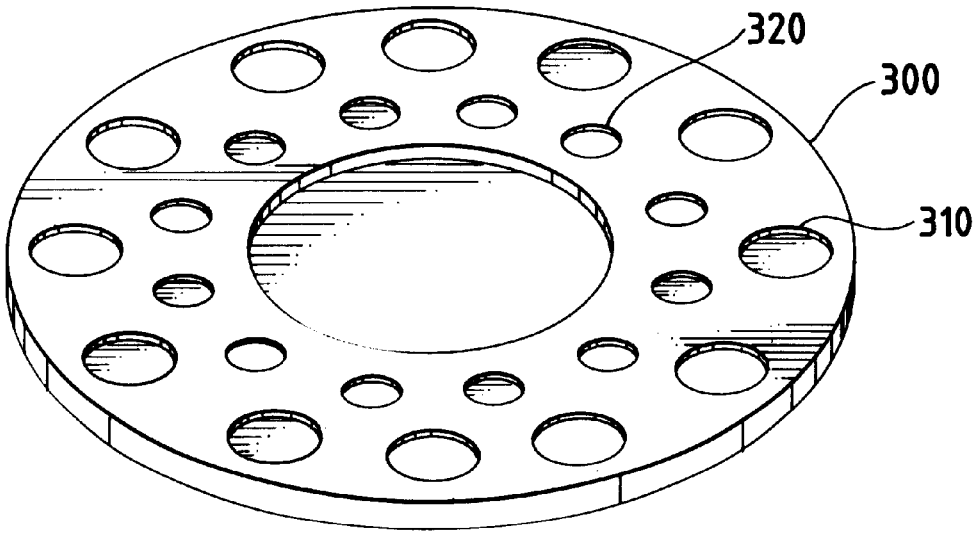
FIG. 4 shows a perspective view of a service tray of the present invention.

FIG. 4 shows a perspective detail of one preferred embodiment of an upper or lower service tray 300 in which two concentric rings of different sized recesses have been provided. Other configurations, sizes and dimensions of recesses may also be utilized and FIG. 4 merely shows one example similar to service trays 24 and 26 of FIG. 1 and service tray 26 of FIG. 5. Outer ring 310 has recesses slightly larger in diameter than inner ring 320. In this instance, a suggested diameter for the larger recesses is approximately 2.0" and the inner ring 310 recess may be approximately 1.5". In such a manner, the larger diameter recesses may accommodate larger bottles, such as those for cologne, lotions, creams and the like, while the smaller diameter recesses may accommodate smaller bottles, such as those for perfume and nail polish.

Figure 5:
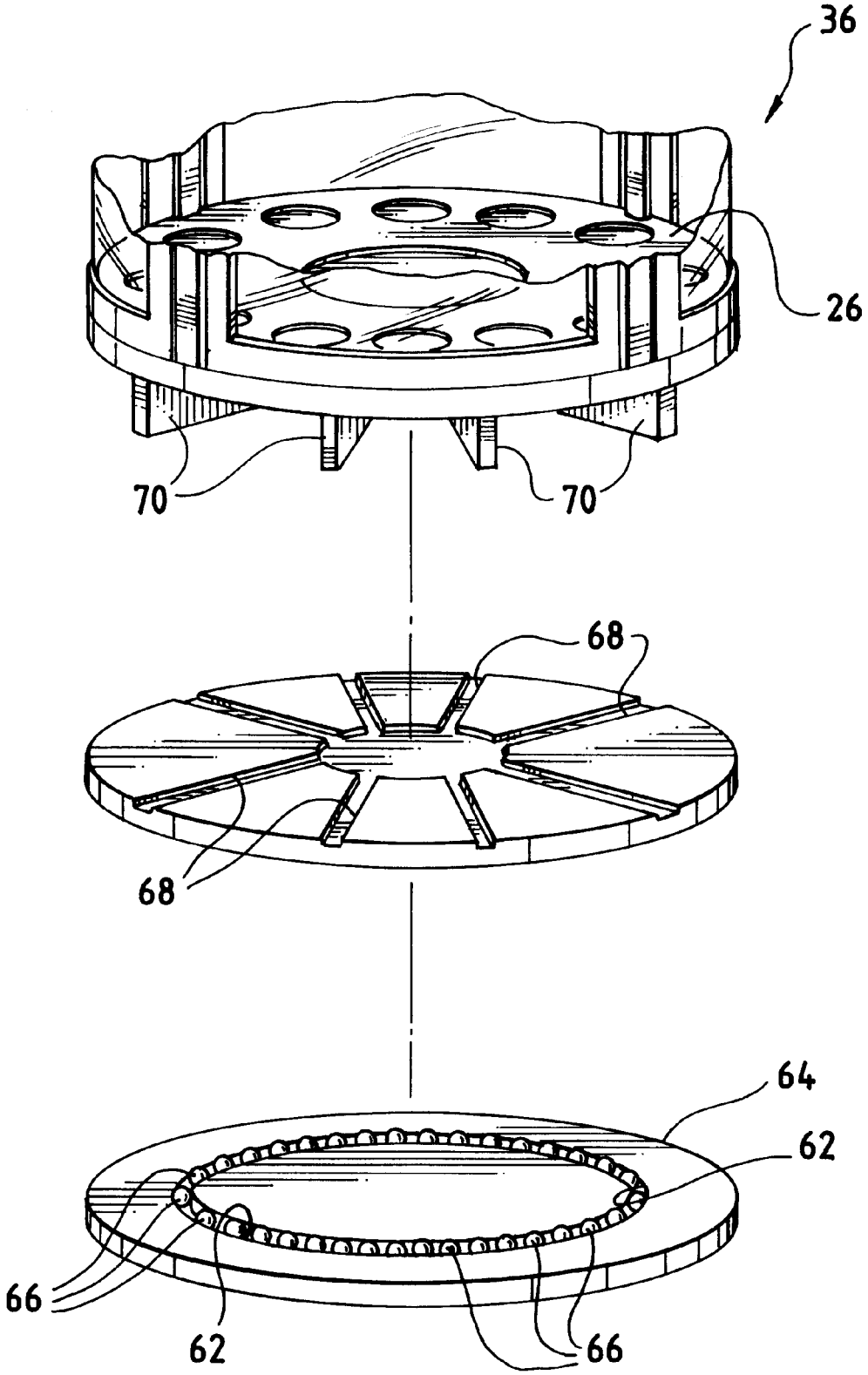
FIG. 5 shows an exploded partial cut away view of the base of the present invention detailing the rotational mechanism.

FIG. 5 shows an exploded view of the rotating base 36 of the rotatable jewelry cabinet 10 of FIG. 1 in which is shown upper disc 58 which has grooves 68 cut to receive drawer wall sides 70. Upper disc 68 has a circular groove cut into it so as to receive a plurality of ball bearings 66. A corresponding lower disc 64 is further provided with a corresponding groove which is adapted to receive the plurality of ball bearings 66. In such a manner, when the upper disc 58 is placed on top of ball bearings 66 in circular grooves 60 and 62 of lower disc 64, the rotatable jewelry cabinet 10 may spin freely.

Although in the foregoing detailed description the present invention has been described by reference to various specific embodiments, it is to be understood that modifications and alterations in the structure and arrangement of those embodiments other than those specifically set forth herein may be achieved by those skilled in the art and that such modifications and alterations are to be considered as within the overall scope of this invention.

What is claimed is:

1. A rotatable jewelry cabinet comprising;

a rotatable base with an upright frame attached thereto;

a plurality of drawers arranged concentrically within the rotatable base;

hook means located within the rotatable jewelry cabinet;

at least one circular curtain wall located within the rotatable jewelry cabinet containing a plurality of apertures adapted to receive both clip on and pierced earrings, and at least one curved transparent door also attached to the upright frame.

2. The jewelry cabinet of claim 1, wherein the rotatable base further has an upper disc and a lower disc both containing a circular groove cut therein and a plurality of ball bearings generally disposed between the two circular grooves.

3. The jewelry cabinet of claim 2, wherein the drawers are substantially wedge shaped.

4. The jewelry cabinet of claim 2, further having at least three upright frame members and at least three curved doors which are attached to the three upright frame members.

5. The jewelry cabinet of claim 4, wherein the curved doors consist from one of the following group of glass, plexiglass, and plastic.

6. The jewelry cabinet of claim 5, wherein the upright frame members are made from an attractive hardwood.

7. The jewelry cabinet of claim 2, further having at least one service tray which has been provided with a plurality of shallow recesses.

8. The jewelry cabinet of claim 7, further having an upper and a lower service tray with a plurality of shallow recesses wherein a plurality of hook means depends from the upper service tray.

9. The jewelry cabinet of claim 8, wherein the shallow recesses are circular in form.

10. The jewelry cabinet of claim 2, wherein the drawers are made from a rigid polymeric substance.

* * * * *